US005961341A

United States Patent [19]

Knowles et al.

[11] Patent Number: 5,961,341

[45] Date of Patent: Oct. 5, 1999

[54] ELECTRICAL TAP CONNECTOR

[75] Inventors: Charles Monteith Knowles, Sandton; Paul Rishworth, Bellevue East, both of South Africa

[73] Assignee: Molex Incorporated, Lisle, Ill.

[21] Appl. No.: 08/906,619

[22] Filed: Aug. 7, 1997

[30] Foreign Application Priority Data

| | | | |
|---|---|---|---|
| Aug. 16, 1996 | [ZA] | South Africa | 96/6947 |
| Aug. 6, 1997 | [ZA] | South Africa | 97/6987 |

[51] Int. Cl.[6] ..... H01R 4/24

[52] U.S. Cl. ..... 439/403

[58] Field of Search ..... 439/403, 404, 439/456, 457, 459

[56] References Cited

U.S. PATENT DOCUMENTS

| | | | |
|---|---|---|---|
| 1,488,636 | 4/1924 | Geiser | 439/410 |
| 3,388,370 | 6/1968 | Elm | 439/402 |
| 3,836,944 | 9/1974 | Lawson | 439/402 |
| 3,985,416 | 10/1976 | Dola et al. | 439/403 |
| 4,040,703 | 8/1977 | Shaffer et al. | 439/402 |
| 4,195,194 | 3/1980 | Kuster et al. | 439/456 |
| 4,552,429 | 11/1985 | van Alst | 439/404 |
| 4,764,125 | 8/1988 | Debortoli | 439/403 |
| 4,778,405 | 10/1988 | Sterken | 439/395 |
| 4,954,098 | 9/1990 | Hollingsworth et al. | 439/404 |
| 5,009,612 | 4/1991 | Rishworth et al. | 439/403 |
| 5,498,172 | 3/1996 | Noda | 439/404 |
| 5,660,559 | 8/1997 | Yamamoto et al. | 439/392 |
| 5,759,065 | 6/1998 | Hatagishi et al. | 436/596 |

FOREIGN PATENT DOCUMENTS

| | | |
|---|---|---|
| 0 470 887 A1 | 2/1992 | European Pat. Off. . |
| 0 478 400 B1 | 10/1994 | European Pat. Off. . |
| 3-67474 | 3/1991 | Japan . |
| 8-124605 | 5/1996 | Japan . |
| 8-162183 | 6/1996 | Japan . |

*Primary Examiner*—Steven L. Stephan
*Assistant Examiner*—Barry M. L. Standig
*Attorney, Agent, or Firm*—James C. Paschall

[57] ABSTRACT

An electrical tap assembly is provided for connecting at least one tap wire to at least one through wire. The assembly includes a dielectric housing body having a wire slot for receiving the tap wire, a through wire passage for receiving the through wire and a terminal-receiving cavity extending in a direction transverse to the wire slot and the through wire passage. A terminal is positionable in the terminal-receiving cavity and includes a first insulation displacement end for connection to the tap wire and a second insulation displacement end for connection to the through wire. The terminal is movably mounted in the cavity for movement between a first position allowing insertion of the tap wire into the wire slot and a second position with the first insulation displacement end terminating the tap wire. A shoulder is provided on the terminal for engagement by an appropriate insertion tool to drive the terminal from its first position to its second position. A dielectric housing closure is mountable on the housing body and is engageable with the through wire in the through wire passage in the housing body for driving the through wire into insulation displacement termination with the second insulation displacement end of the terminal.

14 Claims, 3 Drawing Sheets

ELECTRICAL TAP CONNECTOR

FIELD OF THE INVENTION

This invention generally relates to the art of electrical connectors and, particularly, to an electrical tap connector assembly.

BACKGROUND OF THE INVENTION

Electrical connectors are made in a wide variety of designs and configurations and are used for a wide variety of purposes to connect cable lengths together. One type of electrical connector commonly is called a "tap" connector and is used to make an electrical connection at a given point along or in-line of a through cable or wire. For instance, an electrical tap connector may make an electrical connection between a pair of through wires and a pair of tap wires. The terminations with the wires typically are made by insulation displacement terminals. Electrical tap connectors of this latter type often are called "T-taps".

Still further, there are various applications wherein it is desirable to terminate tap wires in a tap connector at a given time, and, at a later time, connect the tap wires to the through wires. For instance, the connector may be assembled and terminated to the tap wires at a factory or other assembly facility and, at a later time, connect the tap wires to the through wires "on site" of the ultimate usage. One example of such an application is in a mining environment involving explosives. The tap connector may be pre-terminated to short lengths of tap wires at the factory, with the intention that the tap wires ultimately be connected to electronic detonators. This subassembly then is shipped to mines and connected to detonators of explosives at various locations. The miner then terminates the connectors along a length of through wires which lead away from the blasting area, and the remote ends of the through wires are connected to a computer which programs and initiates a blasting sequence.

Another example for using such tap connectors may be in making electrical connections between outside aerial cables to subscriber's premises. Again, the connectors are pre-terminated to short lengths of tap wires at the factory. This subassembly then is shipped for connection on-site to through aerial cables or wires at the aerial location. While this aerial tapping application involves the use of rather flexible and/or softer wires, the mining application described above typically uses stiffer and heavier wire which requires more robust connector components and overall assembly.

The present invention is directed to various improvements in electrical tap connectors of the character described above.

SUMMARY OF THE INVENTION

An object, therefore, of the invention is to provide a new and improved electrical tap connector assembly for connecting at least one tap wire to at least one through wire.

In the exemplary embodiment of the invention, the electrical connector assembly includes a dielectric housing body having a wire slot for receiving the tap wire, a through wire passage for receiving the through wire and a terminal-receiving cavity extending in a direction transverse to the wire slot and the through wire passage. A terminal is provided with a first insulation displacement end for connection to the tap wire and a second insulation displacement end for connection to the through wire. The terminal is positionable in the terminal-receiving cavity with the first insulation displacement end intersecting the wire slot and the second insulation displacement end intersecting the through wire passage. The terminal is movably mounted in the cavity for movement from a first position allowing insertion of the tap wire into the wire slot and a second position with the first insulation displacement end terminating the tap wire. Flats on the terminal are provided for engagement by an appropriate insertion tool to drive the terminal from its first position to its second, terminating position. This termination of the tap wire can be carried out at a factory or other assembly facility, for instance.

The connector includes complementary interengaging stop means between the terminal and the housing body to define the second, terminating position of the terminal. A dielectric housing closure is mountable on the housing body and is engageable with the through wire in the through wire passage. The housing closure is used to drive the through wire into insulation displacement termination with the second insulation displacement end of the terminal, in the same direction that the terminal was driven into its terminating position with the tap wire. This second termination typically would be made "on site" or at a location remote from the factory.

Other features of the invention include interference means between the terminal and the housing body for holding the terminal in its first position. Strain relief means are provided on the housing body remote from the wire slot for receiving a length of the tap wire spaced from the wire slot. In the exemplary embodiment, the strain relief means is provided by a second wire slot extending generally parallel to the first wire slot. The housing body further includes a reservoir for receiving a fluidic sealant. The housing closure includes a plunger for movement into the reservoir to force the fluidic sealant therefrom around the terminal in response to movement of the housing closure to terminate the through wire.

Still another feature of the invention includes interengaging means between the housing body and the housing closure to define a preliminary shipping position of the housing closure on the housing body and preventing the closure from moving to a final terminating position. Generally, the interengaging means is located at a position adjacent the through wire passage such that the interengaging means is blocked by the through wire when inserted into the passage and, thereby, allow the housing closure to move to its final terminating position. Specifically, the interengaging means is provided by a ledge on the housing body engageable by a flexible flange on the housing closure, whereby the flange will flex along the through wire over the ledge when the through wire is inserted into the through wire passage.

The invention also contemplates the method of using the electrical connector assembly described above, whereby the terminal is terminated to the tap wire in a given direction at a first location, such as a factory. The through wire subsequently is terminated to the terminal in that same direction at a second or remote location, such as in the field.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
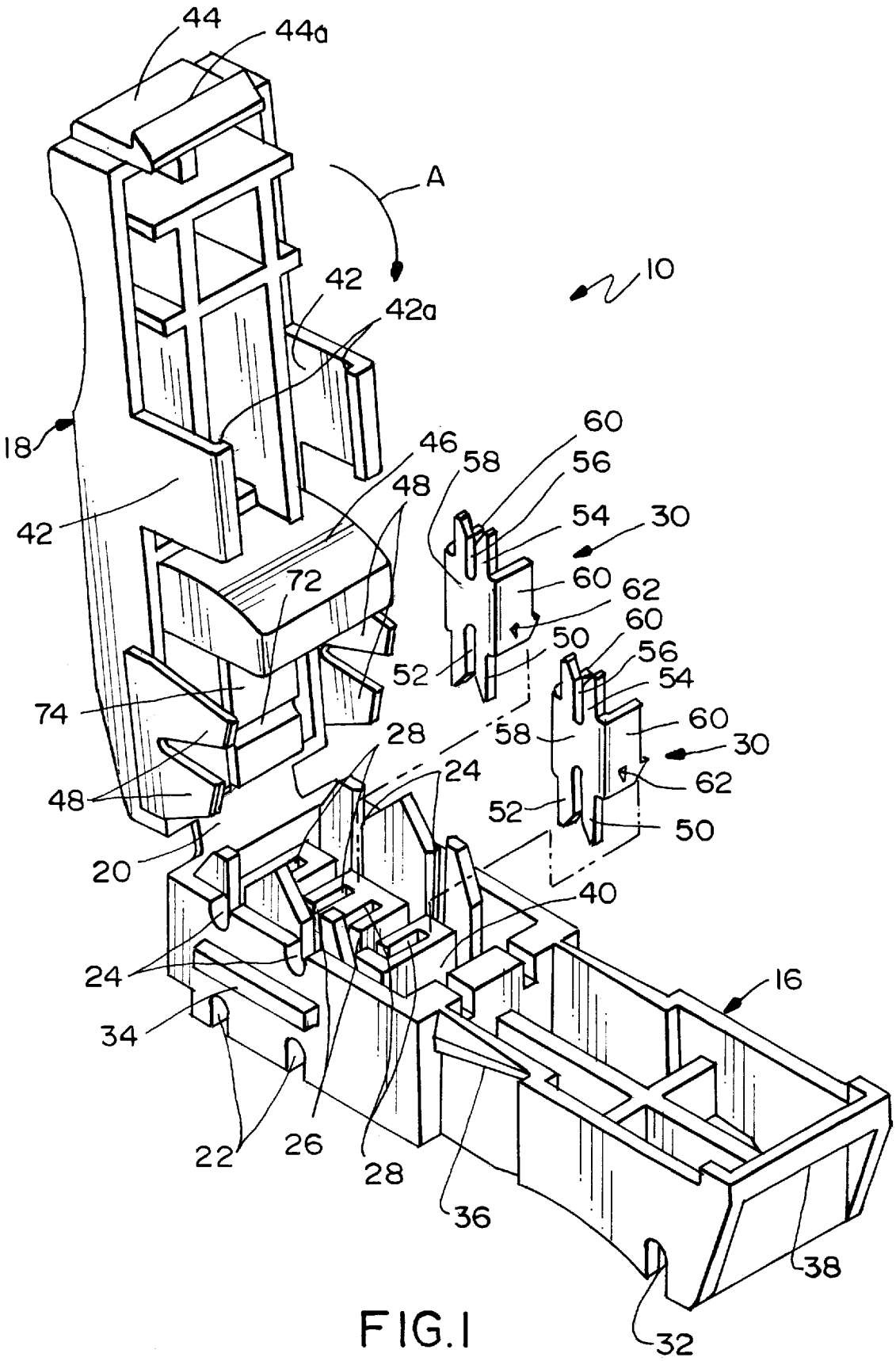
FIG. 1 is a perspective view of the electrical connector assembly of the invention, with the housing closure in open position relative to the housing body, and with the terminals removed to facilitate the illustration.
Figure 3:
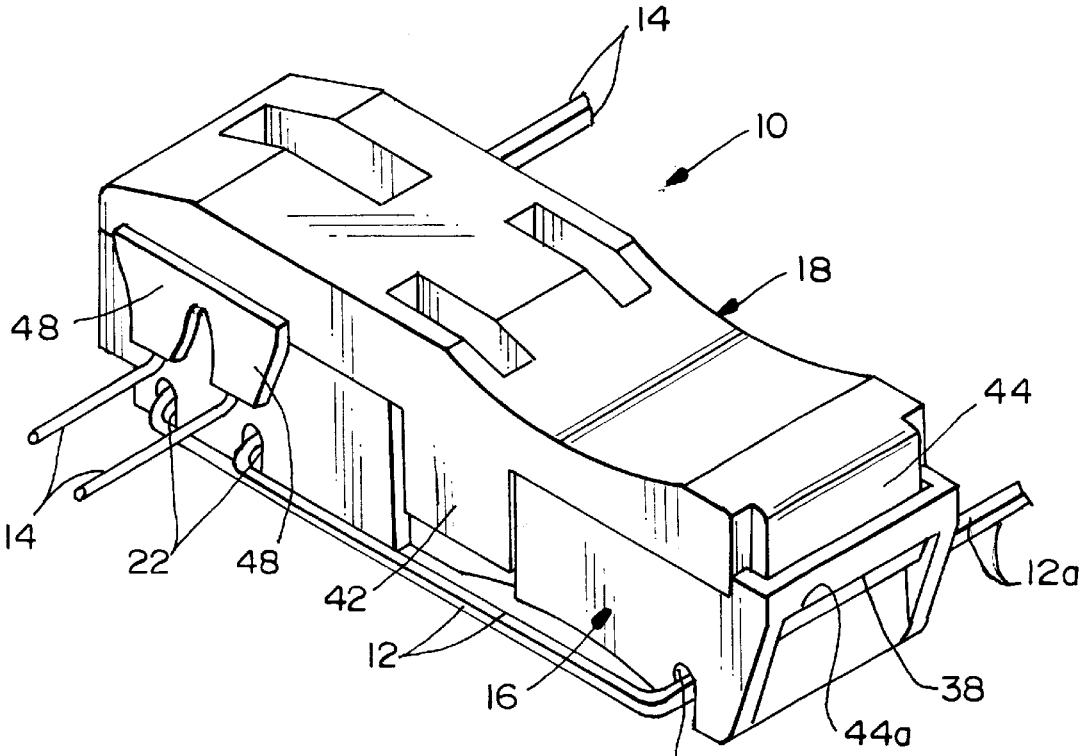
FIG. 3 is a perspective view of the connector assembly in its fully closed and terminated condition.

Referring to the drawings in greater detail, and first to FIG. 1, the features of the invention are embodied in an electrical tap connector assembly, generally designated 10, for connecting at least one tap wire to at least one through wire. Referring briefly to FIG. 3, two tap wires 12 and two through wires 14 are shown terminated by connector assembly 10.

Referring back to FIG. 1, connector assembly 10 includes a dielectric housing body, generally designated 16, and a dielectric housing closure, generally designated 18. The housing body and housing closure are fabricated of molded plastic material and are joined in a one-piece structure by an integral living hinge 20. Therefore, housing closure 18 is movable between an open position and a fully closed or terminating position (shown in FIG. 3).

Housing body 16 includes a pair of wire slots 22 (FIG. 1) for receiving distal ends of the two tap wires 12. The housing body includes a pair of through wire passages 24 for receiving the two through wires 14. The housing body also includes a pair of terminal-receiving cavities 26 having branch cavities 28 for receiving a pair of conductive terminals, generally designated 30. The housing body is elongated and includes a second wire slot 32 to provide a strain relief means for tap wires 12, as seen best in FIG. 3 and described in greater detail hereinafter. The housing body includes a stop ledge 34 on each opposite side thereof, along with a latch shoulder 36 on each side thereof, all for purposes described hereinafter. A front latch shoulder 38 is provided at the front of the housing body. Finally, housing body 16 includes a reservoir 40 for receiving a fluidic sealant material.

Still referring to FIG. 1, as stated above, housing closure 18 is hinged to housing body 16 by integral living hinge 20. The closure is pivotable about hinge 20 in the direction of arrow "A" from a fully open position shown in FIG. 1 to a fully closed and terminating position shown in FIG. 3. The closure has a pair of prelatch arms 42 with inwardly directed hooks 42*a* which latch behind shoulders 36 of housing body 16 to define a preliminary shipping position of the closure relative to the body, as described further hereinafter. The closure has a final latch arm 44 with an outwardly directed hook 44*a* for engaging behind shoulder 38 of housing body 16 to hold the closure in its fully closed and terminating position as shown in FIG. 3. The housing closure has a plunger 46 which moves into reservoir 40 when the closure is closed to force the fluidic sealant from the reservoir and about the terminals to provide waterproofing therefor. The housing closure further includes a pair of flexible flanges 48 on each opposite side thereof for engaging stop ledges 34 on opposite sides of housing body 16 to prevent the closure from moving to its final terminating position in the absence of through wires 14, as described in greater detail hereinafter.

Each terminal 30 includes a first insulation displacement end 50, with a slot 52, for connection to one of the tap wires 12 and a second insulation displacement end 54, with a slot 56, for connection to one of the through wires 14. As is known in the art, slots 52 and 56 are of a size such that the edges of the slots cut through the insulation of the wires and establish an electrical connection with the center conductors or cores of the wires. A generally U-shaped mid-section 58 is disposed between first and second insulation displacement ends 50 and 54, respectively, of each terminal. The U-shaped mid-section defines a pair of wings 60. The terminals are stamped and formed of conductive sheet metal material, and interference detents 62 project outwardly from the outsides of wings 60.

In assembly, first insulation displacement ends 50 and mid-sections 58 of terminals 30 are inserted downwardly into terminal-receiving cavities 26, with wings 60 of the terminals moving into branch cavities 28 shown clearly in FIG. 1. When assembled, first insulation displacement ends 50 of the terminals are aligned with and, in essence, intersect wire slots 22 for tap wires 12, and second insulation displacement ends 54 are in alignment with or intersect through wire passages 24 for through wires 14.

Figure 2A:
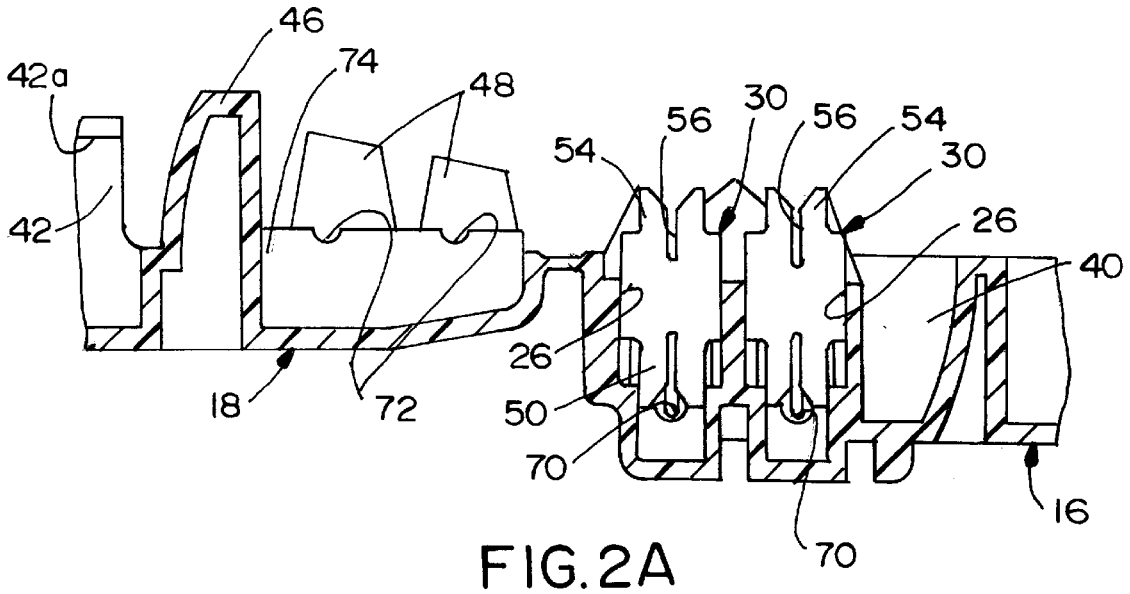
FIGS. 2A–2C are fragmented sectional views showing the sequence of termination of the terminals to the tap wires and through wires.
Figure 2B:
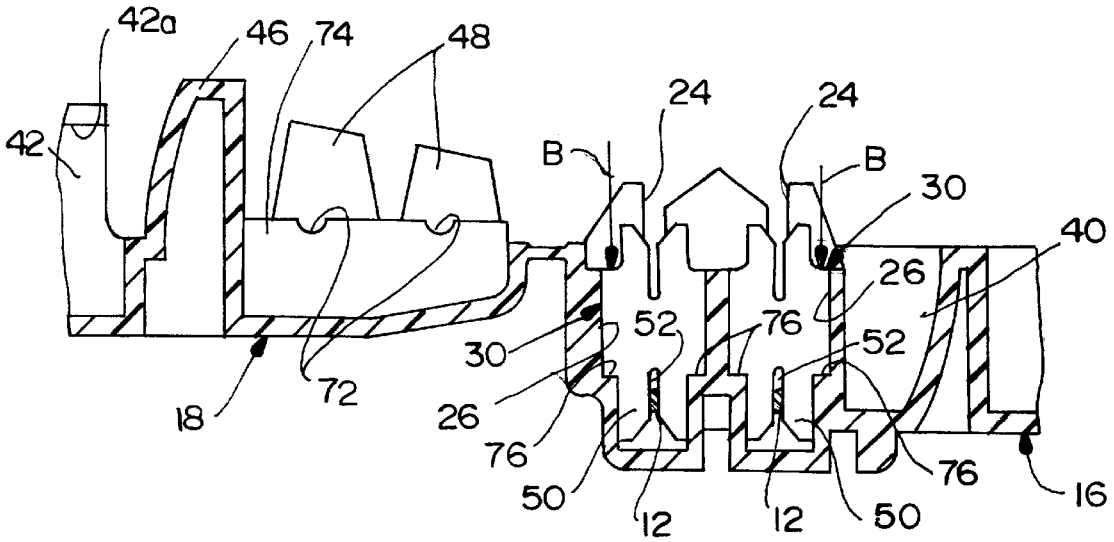
Figure 2C:
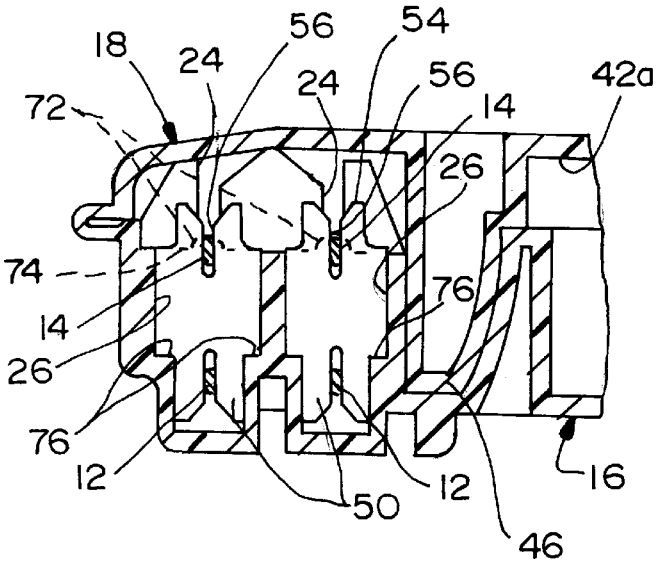

More particularly, FIGS. 2A–2C show sequential views of terminating terminals 30 to tap wires 12 and through wires 14. Referring first to FIG. 2A, housing closure 18 is shown in a fully open position relative to housing body 16. Terminals 30 are shown in first, inoperative positions within terminal-receiving cavities 26. In this first, inoperative position of the terminals, interference detents 62 (FIG. 1) dig into the plastic material of the housing body at the sides of branch cavities 28 to hold the terminals in this first, inoperative position.

Referring next to FIG. 2B, the distal ends of tap wires 12 then are inserted into wire slots 22 (FIG. 1) until the wires rest on interior notched anvils 70 (FIG. 2A) inside housing body 16 at the bottom of terminal-receiving cavities 26.

Still referring to FIG. 2B, the next step is to drive terminals 30 downwardly in the direction of arrows "B" to terminate the terminals with tap wires 12 by forcing the conductors of the tap wires into slots 52 at first insulation displacement ends 50 of the terminals. This termination process is carried out by appropriate insertion tooling at the factory or other assembly facility. The tops of insulation displacement end 54 or wings 60 of the terminals provide flats for engagement by the insertion tool to drive the terminals from their first, inoperative positions shown in FIG. 2A to their second, terminating positions shown in FIG. 2B.

After terminals 30 are terminated to tap wires 12 as described above, a fluidic sealant such as grease may be added to the reservoir 40, and the housing closure 18 is pivoted in the direction of arrow "A" (FIG. 1) until hooks 42*a* of pre-latch arms 42 engage behind latch shoulders 36 of housing body 16. This defines a preliminary position of the housing closure on the housing body for shipping of the subassembly to the field. In this preliminary shipping position, the distal ends of flexible flanges 48 on the housing closure abut against stop ledges 34 on the housing body and prevent the housing closure from moving any further toward its final terminating position. This prevents the fluidic sealant from being dispersed into the terminal cavities prior to terminating.

After the subassembly is shipped to the field, pre-latch arms 42 are spread apart, either by manual movement or by pivoting the housing closure 18 in a direction opposite of arrow "A" during which the hooks 42*a* ride on the inclined surface of latch shoulder 36. The spread apart hooks 42*a* disengage from latch shoulders 36 on the housing body, and the housing closure is opened to allow through wires 14 to be inserted into through wire passages 24 into alignment with slots 56 in second insulation displacement ends 54 of terminals 30.

Referring to FIG. 2C, housing closure 18 then is manually closed to drive through wires 14 into insulation displacement termination with the terminals. This is effected by means of a pair of notches 72 (FIG. 2C) of an interior driving block 74 engaging the through wires and driving the wires into the terminals in the same direction that the terminals were driven into insulation displacement termination with tap wires 12. FIG. 2C, along with FIG. 2B, show stop shoulders 76 at the bottoms of terminal-receiving cavities 26 for engaging the bottom edges of wings 60 of the terminals to, thereby, define complementary interengaging stop means between the terminals and the housing body to define the second, terminating positions of the terminals, as well as to prevent the terminals from moving further in the terminating direction as through wires 14 are terminated to the terminals.

FIG. 3 shows the fully closed position of housing closure 18 onto housing body 16 with hook 44*a* of final latch arm 44 of the closure engaging behind latch shoulder 38 of the body. FIG. 3 also shows tap wires 12 having been extended through second wire slot 32 which extends generally parallel to first wire slots 22. This second wire slot extends generally parallel to the first wire slots and provides a strain-relief means to protect the terminations of the wires with terminals 30 in the event that extraneous forces are applied or pulled on the proximal ends 12*a* (FIG. 3) of tap wires 12.

Lastly, as stated above, flexible flanges 48 of housing closure 18 abut against stop ledges 34 (FIG. 1) of housing body 16 when the closure is in its preliminary shipping position relative to the housing. In other words, the abutment of the flexible flanges with the stop ledges prevent the closure from being forced to its final terminating position whereat it becomes locked. However, this feature is overcome when through wires 14 are terminated in the assembly, as shown in FIG. 3. In other words, flexible flanges 48 are located in alignment with through wire passages 24 in the housing body and, thereby, in alignment with the through wires, themselves, when terminating in the assembly. Consequently, flexible flanges 48 will ride along the terminated through wires and over the tops of stop ledges 34 to allow the housing closure to move to its final terminating position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical tap connector assembly for connecting at least one tap wire to at least one through wire, comprising:

a dielectric housing body having a wire slot for receiving the tap wire, a through wire passage for receiving the through wire and a terminal receiving cavity extending in a direction transverse to one of the wire slot and the through wire passage;

a terminal having a first insulation displacement portion for connection to the tap wire and a second insulation displacement portion for connection to the through wire, the terminal being positionable in the terminal-receiving cavity with the first insulation displacement portion intersecting the wire slot and the second insulation displacement portion intersecting the through wire passage, the terminal being movably mounted in the cavity for movement from a first position allowing insertion of the tap wire into the wire slot to a final position with the first insulation displacement portion terminating the tap wire without the second insulation displacement portion terminating the through wire, and a flat surface on the terminal for engagement to drive the terminal into a final position in the terminal-receiving cavity;

complementary interengaging stops between the terminal and the housing body to define said final position of the terminal; and a dielectric housing closure mountable on the housing body and engageable with the through wire in the through wire passage in the housing body for driving the through wire into insulation displacement termination with the second insulation displacement portion of the terminal.

2. The electrical connector assembly of claim 1, including an integral hinge interconnecting the housing closure to the housing body.

3. The electrical connector assembly of claim 1, including pairs of said wire slots, through wire passages and terminal-receiving cavities for receiving pairs of said tap wires, through wires and terminals, respectively.

4. The electrical connector assembly of claim 1, wherein the shoulders of the terminal are engageable by the appropriate insertion tool to drive the terminal in the terminal-receiving cavity from the first position to the final position.

5. The electrical connector assembly of claim 4, including interference means between the terminal and the housing body for holding the terminal in the first position.

6. The electrical connector assembly of claim 1, including strain relief means on the housing body remote from the wire slot for receiving a length of the tap wire spaced from the wire slot.

7. The electrical connector assembly of claim 6 wherein said strain relief means comprises a second wire slot generally parallel to said first wire slot.

8. The electrical connector assembly of claim 1 wherein the dielectric housing closure is manually used to drive the through wire into insertion displacement termination without the assistance of a tool.

9. A method of connecting at least one tap wire to at least one through wire in an electrical tap connector assembly, comprising the steps of:

providing a dielectric housing body with a wire slot for receiving the tap wire, a through wire passage for receiving the through wire and a terminal-receiving cavity extending in a direction transverse to the wire slot and the through wire passage;

providing a terminal with a first insulation displacement portion for connection to the tap wire and a second insulation displacement portion for connection to the through wire;

positioning the terminal in the terminal-receiving cavity with the first insulation displacement end intersecting the wire slot and the second insulation displacement end intersecting the through wire passage;

inserting the tap wire into said wire slot;

moving the terminal from a first position allowing said insertion of the tap wire into the wire slot to a final position terminating the first insulation displacement portion with the tap wire without the second insulation displacement portion terminating the through wire;

inserting the through wire in said wire passage;

mounting a housing closure on the housing body in a preliminary shipping position for shipment of the assembly to a remote location whereat the through wire can be terminated to the second insulation displacement portion of the terminal.

10. The method of claim 9 wherein the assembly is provided with an integral hinge interconnecting the housing closure and the housing body, and the housing closure is pivoted relative to the housing body about the hinge to its preliminary shipping position.

11. The method of claim 9, including preventing the housing closure from moving beyond its preliminary shipping position when located thereat.

12. The method of claim 9, including the step of moving the housing closure into engagement with a through wire in the through wire passage in the housing body and driving the through wire into insulation displacement termination with the second insulation displacement end of the terminal.

13. An electrical tap connector assembly for connecting at least one tap wire to at least one through wire, comprising:

a dielectric housing body having a wire slot for receiving the tap wire, a through wire passage for receiving the through wire and a terminal receiving cavity extending in a direction transverse to one of the wire slot and the through wire passage;

a terminal having a first insulation displacement portion for connection to the tap wire and a second insulation displacement portion for connection to the through wire, the terminal being positionable in the terminal-receiving cavity with the first insulation displacement portion intersecting the wire slot and the second insulation displacement portion intersecting the through wire passage, and a flat surface on the terminal for engagement to drive the terminal into a final position in the terminal-receiving cavity;

complementary interengaging stops between the terminal and the housing body to define said final position of the terminal;

strain relief means on the housing body remote from the wire slot for receiving a length of the tap wire spaced from the wire slot; and a dielectric housing closure mountable on the housing body and engageable with the through wire in the through wire passage in the housing body for driving the through wire into insulation displacement termination with the second insulation displacement portion of the terminal.

14. The electrical connector assembly of claim 13 wherein said strain relief means comprises a second wire slot generally parallel to said first wire slot.

* * * * *